United States Patent [19]

Molay

[11] 4,076,957

[45] Feb. 28, 1978

[54] PORTABLE SOUND DEVICE FOR PUBLIC ADDRESS

[75] Inventor: Ira Molay, Wenham, Mass.

[73] Assignee: Audiophonics Corporation, Beverly, Mass.

[21] Appl. No.: 705,474

[22] Filed: Jul. 15, 1976

[51] Int. Cl.[2] ..... H04R 3/00

[52] U.S. Cl. ..... 179/1 AT; 179/1 MG

[58] Field of Search ..... 179/1 A, 1 AT, 1 E, 179/1 MG; 360/1, 6, 88, 96, 137; 325/352, 361

[56] References Cited

U.S. PATENT DOCUMENTS

| | | | |
|---|---|---|---|
| 2,820,890 | 1/1958 | Koch | 325/352 |
| 3,042,749 | 7/1962 | Johnson | 179/1 MG |
| 3,126,450 | 3/1964 | Neil et al. | 179/1 E |
| 3,258,534 | 6/1966 | Goldsworthy | 179/1 MG |

FOREIGN PATENT DOCUMENTS

| | | | |
|---|---|---|---|
| 1,032,055 | 6/1953 | France | 325/352 |

OTHER PUBLICATIONS

Lafayette Catalog, No. 740, 1944, p. 160.

*Primary Examiner*—Kathleen H. Claffy
*Assistant Examiner*—E. S. Kemeny
*Attorney, Agent, or Firm*—Wolf, Greenfield & Sacks

[57] ABSTRACT

A relatively small, compact and portable public address sound device embodied in a carrying case having a strap and a sound previous wall behind which the speaker is mounted. The case has a top flap which may be secured closed, has a volume control knob extending from the side of the case and accommodates a removable microphone carrying box at the top of the case. A rechargeable battery pack is supported in the case from a bracket which also supports the speaker, volume control potentiometer and a circuit component board. The removable box is secured in the carrying case by snaps.

14 Claims, 4 Drawing Figures

PORTABLE SOUND DEVICE FOR PUBLIC ADDRESS

BACKGROUND OF THE INVENTION

The present invention relates in general to a sound device and is concerned, more particularly, with a relatively small, compact and portable public address sound device. The sound device is contained in a relatively small carrying case and is useful for addressing groups either indoors or out of doors. Some of the many uses of the device are by industry, educators, sight seeing guides, auctioneers, instructors and many others.

One object of the present invention is to provide a compact and easily portable public address device that can be easily carried by a person preferably by means of a carrying strap slung over the person's shoulder.

Another object of the present invention is to provide a portable public address system that is embodied in an aesthetically appealing carrying case.

Another object of the present invention is to provide a portable public address device wherein the speaker and internal circuitry are easily removed from the carrying case of the device, thereby providing ready access to the electrical components of the device for maintenance or other purposes.

A further object of the present invention is to provide a volume control knob that is readily accessible on an outside wall of the carrying case of the device and a microphone having a built-in on-off switch.

Still another object of the present invention is to provide a portable public address device that is provided with a built-in storage pocket or box for the microphone associated with the device.

A further object of the present invention is to provide a portable public address system including a rechargeable battery pack.

Still a further object of the present invention is to provide a novel means for securing the microphone cable to prevent accidental breakage of the cable.

SUMMARY OF THE INVENTION

To accomplish the foregoing and other objects of this invention, the portable public address system or device comprises a speaker, a microphone, including a microphone cable, amplifier means coupled between the microphone and the speaker and a power source couples to the amplifier means for providing operating power therefor. These electrical components including the speaker disposed in a carrying case having a top opening flap for providing access to the interior of the case. A mounting bracket is preferably provided for mounting the speaker with the cone of the speaker adjacent a sound pervious wall of the carrying case. This bracket may also support a component board, a volume control potentiometer having its knob extending external of the case, and a rechargeable battery pack. A removable box is disposed at the top of the case for housing the microphone and microphone cable. With the box removed and the volume control knob withdrawn it is quite easy to remove the contents from the carrying case all of which are supported on the common support bracket. The carrying case preferably has an external strap mounted on opposite sides thereof for providing easy carrying for the case.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
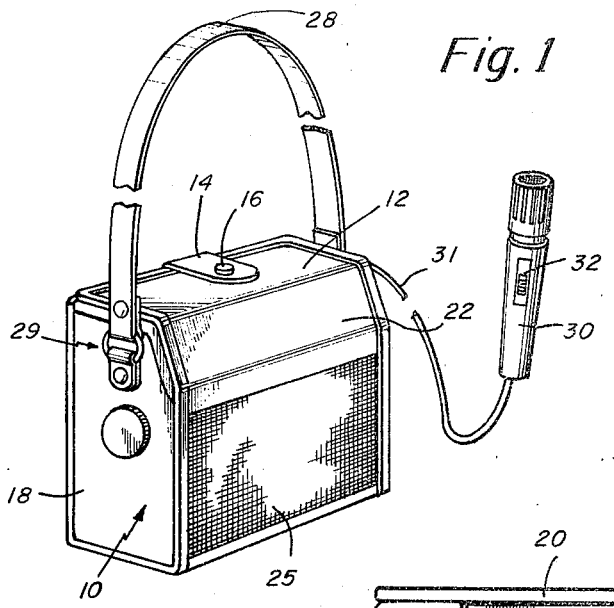
FIG. 1 is a perspective view showing the device of this invention with the microphone removed from the carrying case.

Referring now to FIG. 1 there is shown a carrying case 10 having a top flap 12 which may be opened and is shown in FIG. 1 in its closed position by the use of the securing strap 14. The strap 14 is secured by means of a conventional snap button 16. The carrying case 10 may be constructed of a leather or vinyl material including side walls 18, back wall 20, front wall 22, and bottom wall 24. The front wall 22 contains a plurality of apertures 23 for permitting sound passage. A pervious grid-like material 25 covers the pervious wall 22.

FIG. 1 also shows a strap 28 which is secured at opposite ends to the side walls 18 of the carrying case. The strap 28 may be adjustable and is secured. A conventional securing ring arrangement 29 is used at either end of the strap 28 for securing the strap to the carrying case. In FIG. 1 the microphone 30 is shown connected by way of microphone cable 32 to the interior of the carrying case 10. The microphone 30 may be of the dynamic cardioid type having an on-off switch 32.

Figure 4:
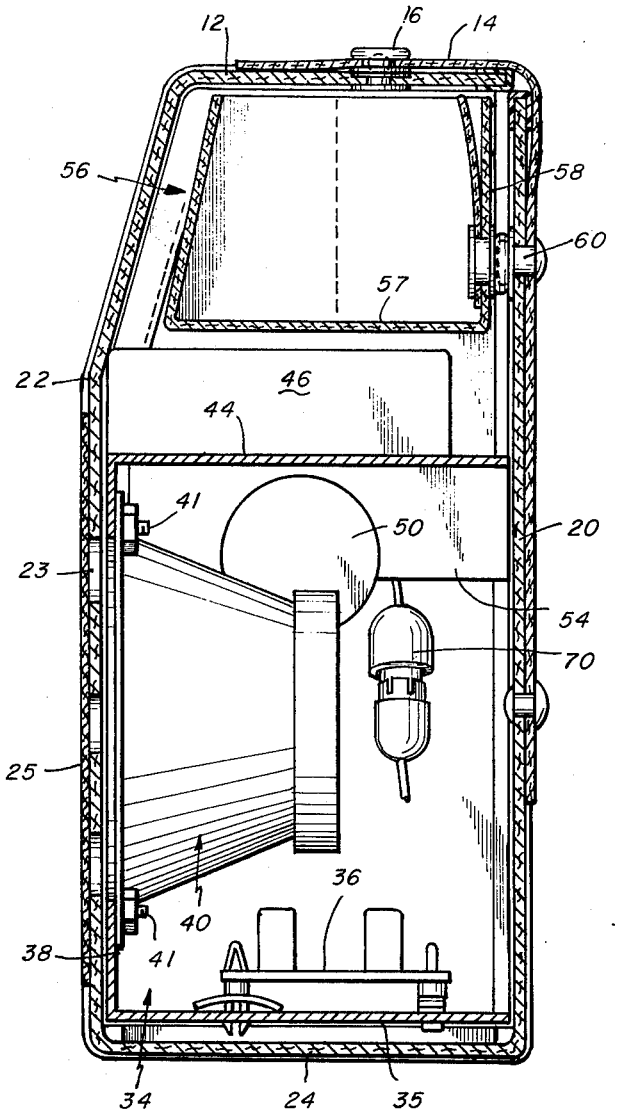
FIG. 4 is a cross sectional view taken along line 4—4 of FIG. 3.

Most of the electronic components are mounted inside of the carrying case 10 on a support bracket 34 which is shown in a cross section in FIG. 4. One leg 35 of the support bracket 34 supports a component board 36. The board 36 may have amplifier circuitry secured thereto. In the drawings the electrical wiring is not completely shown. The specific circuitry is disclosed in my copending application Serial No.

The wall 38 of the bracket 34 has the speaker 40 supported therefrom by means of supporting screws 41. The wall 38, of course, has an aperture therethrough of about the same size as the face of the speaker so as to permit sound from the speaker to be transmitted through the carrying case wall 22 and the pervious cover wall 25. The speaker 40 may be a 3 × 5 inch oval speaker with a ceramic magnet.

The support bracket 34 also comprises a top leg 44 for supporting the replaceable battery pack 46. The battery pack 46 is of conventional design including nicad batteries and is secured to the leg 44 by means of securing screws 47 shown in FIGS. 2 and 3. The battery pack 46 is of the rechargeable type and as shown in FIG. 2 includes a recharging terminal 49 which is readily accessible through the top of the device.

Figure 3:
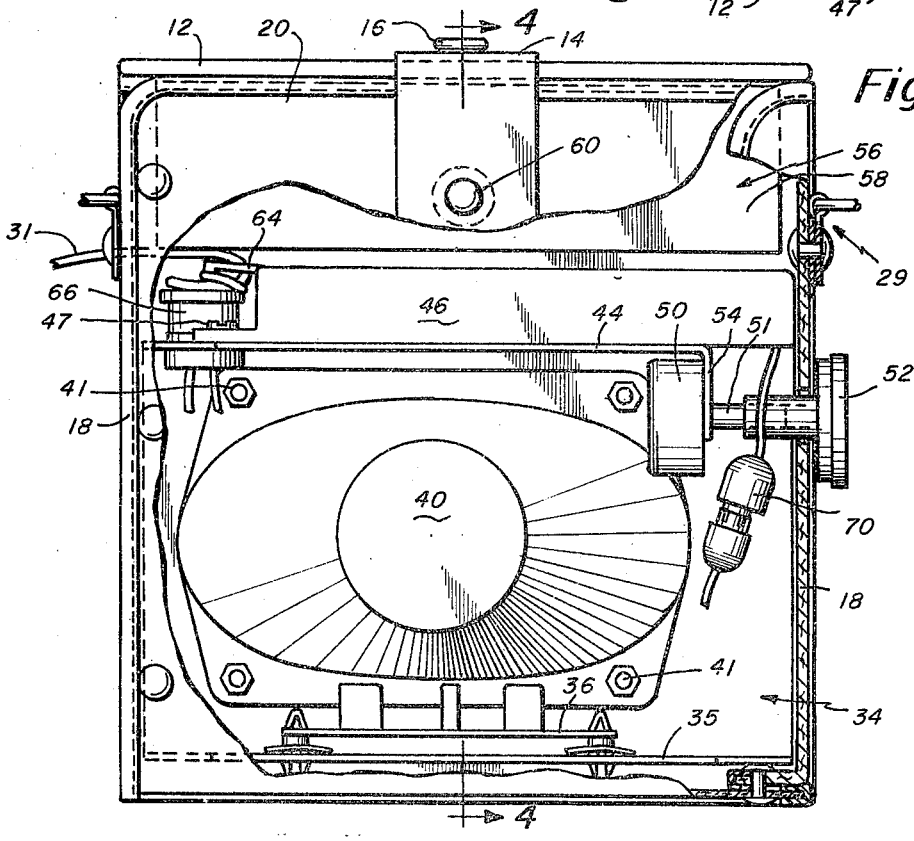
FIG. 3 is a rear view of the device shown in FIG. 1 with the carrying case partially cut away to expose the inside thereof.

FIGS. 3 and 4 also show a volume control potentiometer 50 which is wired to the component board 36. The potentiometer 50 has a control stem 51 to which the volume control knob 52 is secured. The knob 52 may be withdrawn from the stem 51 to permit the support bracket 34 to be withdrawn from the carrying case for maintenance purposes or other purposes. The potentiometer 50 is supported from a flange 54 which is integrally formed with the top leg 44 of the support bracket.

A holder 56 which may be constructed of a relatively rigid cardboard-like material is disposed at the top of the carrying case. This holder is shown in a cross-sectional view in FIG. 4 and is shown from the top in FIG. 2. The holder 56 is in the shape of a box having a bottom wall 57 and a back wall 58. A snap arrangement 60 is used for holding the holder 56 in a position as shown in FIG. 4. The snap arrangement 60 forms a dual function in that it retains the securing strap 14 in place and also extends inwardly so that the holder 56 can be snapped in place inside of the carrying case.

Figure 2:
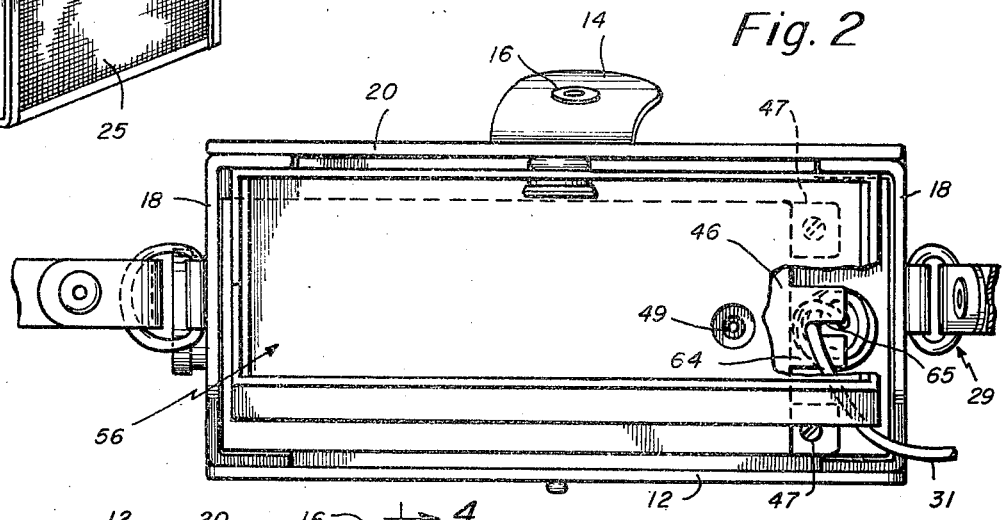
FIG. 2 is a top view of a device shown in FIG. 1 with the flap in its open position.

FIGS. 2 and 3 show the microphone cable 31 extending into the carrying case. The cable 31 is secured in the case with the use of a slotted flap 64 which is a projection from the battery pack 46. The flap 64 has a slot 65 through which the cable 31 extends. The cable 31 may then wrap in the manner shown in FIG. 3 and connect to a connector 66 mounted on the top leg 44 of the support bracket. FIG. 3 shows two wires extending from the bottom of this connector 66. These microphone wires may couple to the component board 36 for providing connection from the microphone to the amplifier circuitry. Also, wiring may connect, although it is not shown in the drawings, from the component board 36 to the speaker 40. It is noted that in FIG. 3 there is shown a fuse holder 70 connected in a line coupling from the battery pack 46. This line connects also to the component board for providing power to the amplifier circuitry on the component board.

When the microphone 30 is not in use the cable 31 may be folded and placed along with the microphone 30 in the holder 56. The carrying case can be secured in a closed position by means of the securing strap 14 and the sound system is easily carried much like a portable radio.

What is claimed is:

1. A portable sound device comprising, in combination;

a speaker, a microphone including a microphone cable, amplifier means coupled intermediate the microphone and speaker, a rechargeable power source coupled to the amplifier means, a carrying case containing at least the speaker, power source and amplifier means, and having a top opening flap, a securing strap on the carrying case for holding the top flap closed, bracket means for mounting the speaker with the core of the speaker adjacent a sound pervious wall of the carrying case, a removable box disposed at the top of the case for housing the microphone and microphone cable and snap means on the removable box for securing the box in position in the carrying case.

2. A sound device as set forth in claim 1 wherein said means for mounting includes a support bracket having a lower leg resting at the bottom of the carrying case and an upright wall having an aperture with the speaker attached to the upright wall with the cone of the speaker extending about the aperture.

3. A sound device as set forth in claim 2 wherein the support bracket further has a top leg for supporting the power source and a flange for supporting a volume control potentiometer.

4. A sound device as set forth in claim 3 wherein said power source comprises a rechargeable battery pack.

5. A sound device as set forth in claim 4 wherein said battery pack defines a slotted tab for holding the microphone cable in a fixed position.

6. A sound device as set forth in claim 2 including an electrical component board and means for supporting the board from the lower leg of the support bracket.

7. A sound device as set forth in claim 2 wherein the sound pervious wall of the carrying case has at least one aperture covered on the outside with a sound pervious cover.

8. A sound device as set forth in claim 7 wherein the wall has a plurality of apertures.

9. A sound device as set forth in claim 1 including a fastening member for fixedly securing the securing strap to the carrying case and further having means for accommodating on the inside of the carrying case the snap means for supporting the box within the carrying case.

10. A portable sound device comprising, in combination;

a carrying case having a bottom, side walls, a back wall, a sound pervious front wall and a top flap that may be opened and closed, a securing strap on the carrying case for holding the top flap closed, removeable bracket means disposed in the carrying case and having a front wall, a bottom leg, a top leg, and a third leg depending in a top-to-bottom direction from the top leg, a speaker, means for mounting the speaker to the front wall of the bracket means, said front wall having an opening facing the pervious wall of the carrying case permitting the audio output from the speaker to be directed outwardly of the carrying case, amplifier means within the carrying case, a component board for supporting the amplifier means, means for mounting the component board from the top surface of the bottom leg of the bracket means, a microphone including a microphone cable coupling to the amplifier means, a rechargeable battery pack having a recharge connection, means for mounting the battery pack to the top surface of the top leg of the bracket means with the recharge connection directed upwardly to provide ready access thereto, a volume control potentiometer, means for mounting the potentiometer to the third leg of the bracket means, a removable knob for the potentiometer extending through a hole in the carrying case for operating the potentiometer, and a removable holder disposed at the top of the carrying case over the battery pack for housing the microphone and microphone cable.

11. A portable sound device as set forth in claim 10 wherein said bracket means is a single piece metal bracket with the width of the top and bottom legs being on the order of the width of the carrying case.

12. A portable sound device as set forth in claim 10 wherein said securing strap has an elongated shape, means for securing one end of the strap to the back wall of the carrying case and snap means at the other end of the strap for securing the strap to the flap of the carrying case.

13. A portable sound device as set forth in claim 12 wherein said means securing one end of the strap includes a fastener for fixedly securing the strap to the case and further accommodating on the inside of the carrying case a snap fixed to the holder for supporting the holder in the carrying case.

14. A portable sound device as set forth in claim 13 wherein said holder has a hole therein to provide access to the recharge connection.

* * * * *